US009649849B2

(12) United States Patent
Ohtsu et al.

(10) Patent No.: US 9,649,849 B2
(45) Date of Patent: May 16, 2017

(54) INK CIRCULATION DEVICE AND INK JET RECORDING APPARATUS

(71) Applicant: TOSHIBA TEC KABUSHIKI KAISHA, Tokyo (JP)

(72) Inventors: Kazuhiko Ohtsu, Mishima Shizuoka (JP); Kazuhiro Hara, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/186,285

(22) Filed: Jun. 17, 2016

(65) Prior Publication Data

US 2016/0368274 A1 Dec. 22, 2016

(30) Foreign Application Priority Data

Jun. 17, 2015 (JP) ..... 2015-121955

(51) Int. Cl.

| | |
|---|---|
| ***B41J 2/18*** | (2006.01) |
| *B41J 2/14* | (2006.01) |
| *B41J 2/175* | (2006.01) |

(52) U.S. Cl.

CPC ..... *B41J 2/18* (2013.01); *B41J 2/175* (2013.01); *B41J 2/17596* (2013.01); *B41J 2/1408* (2013.01); *B41J 2/14088* (2013.01); *B41J 2/17593* (2013.01)

(58) Field of Classification Search

None

See application file for complete search history.

(56) References Cited

U.S. PATENT DOCUMENTS

2011/0242155 A1* 10/2011 Bansyo ..... B41J 2/175 347/6

FOREIGN PATENT DOCUMENTS

| | | |
|---|---|---|
| JP | 04294144 A * | 10/1992 |
| JP | 2014-195932 | 10/2014 |
| WO | 2013/128945 | 9/2013 |

* cited by examiner

*Primary Examiner* — Lisa M Solomon

(74) *Attorney, Agent, or Firm* — Patterson & Sheridan, LLP

(57) ABSTRACT

According to one embodiment, an ink circulation device includes a first tank which stores ink to be supplied to an inkjet head, a second tank which stores the ink returned from the ink jet head, and a circulation pump which circulates the ink stored in the second tank to the first tank. In addition, the ink circulation device according to the embodiment further includes a heating device which is in contact with and heats a bottom surface of the first tank, a bottom surface of the second tank, and a bottom surface of the circulation pump.

20 Claims, 12 Drawing Sheets

INK CIRCULATION DEVICE AND INK JET RECORDING APPARATUS

CROSS-REFERENCE TO RELATED APPLICATION

This application is based upon and claims the benefit of priority from Japanese Patent Application No. 2015-121955, filed Jun. 17, 2015, the entire contents of which are incorporated herein by reference.

FIELD

Embodiments described herein relate generally to an ink circulation device and an ink jet recording apparatus.

BACKGROUND

Generally, an ink circulation device is used for an ink jet recording apparatus which discharges ink and records images onto a recording medium. This type of ink circulation device reduces omissions of discharge of ink droplets by removing bubbles or foreign materials generated inside nozzles of an ink jet head.

The ink used in the ink jet recording apparatus has a temperature zone (optimum temperature) suitable for discharging the ink droplets. If the ink is used at a temperature outside the temperature zone, there is a concern that there may be deterioration in a discharging performance of the apparatus.

Here, as an exemplary conventional technology of heating the ink stored in a tank inside the ink jet recording apparatus, ink may be directly heated by providing a heater inside the tank.

DETAILED DESCRIPTION

In general, according to one embodiment, an ink circulation device includes a first tank which stores ink to be supplied to an ink jet head, a second tank which stores the ink returned from the ink jet head, and a circulation pump which circulates the ink stored in the second tank to the first tank. In addition, the ink circulation device according to the embodiment further includes a heating device which is in contact with and heats a bottom surface of the first tank, a bottom surface of the second tank, and a bottom surface of the circulation pump.

Hereinafter, an inkjet recording apparatus 1 and an ink jet head unit 10 according to an exemplary embodiment will be described with reference to FIG. 1 to FIG. 12.

Figure 1:
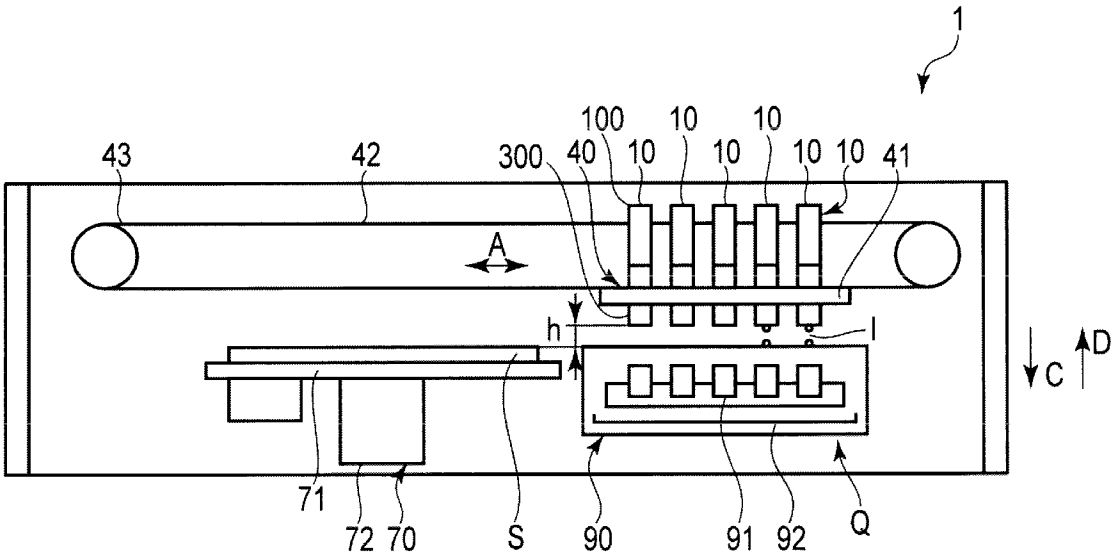
FIG. 1 is a side view of an ink jet recording apparatus.
Figure 2:
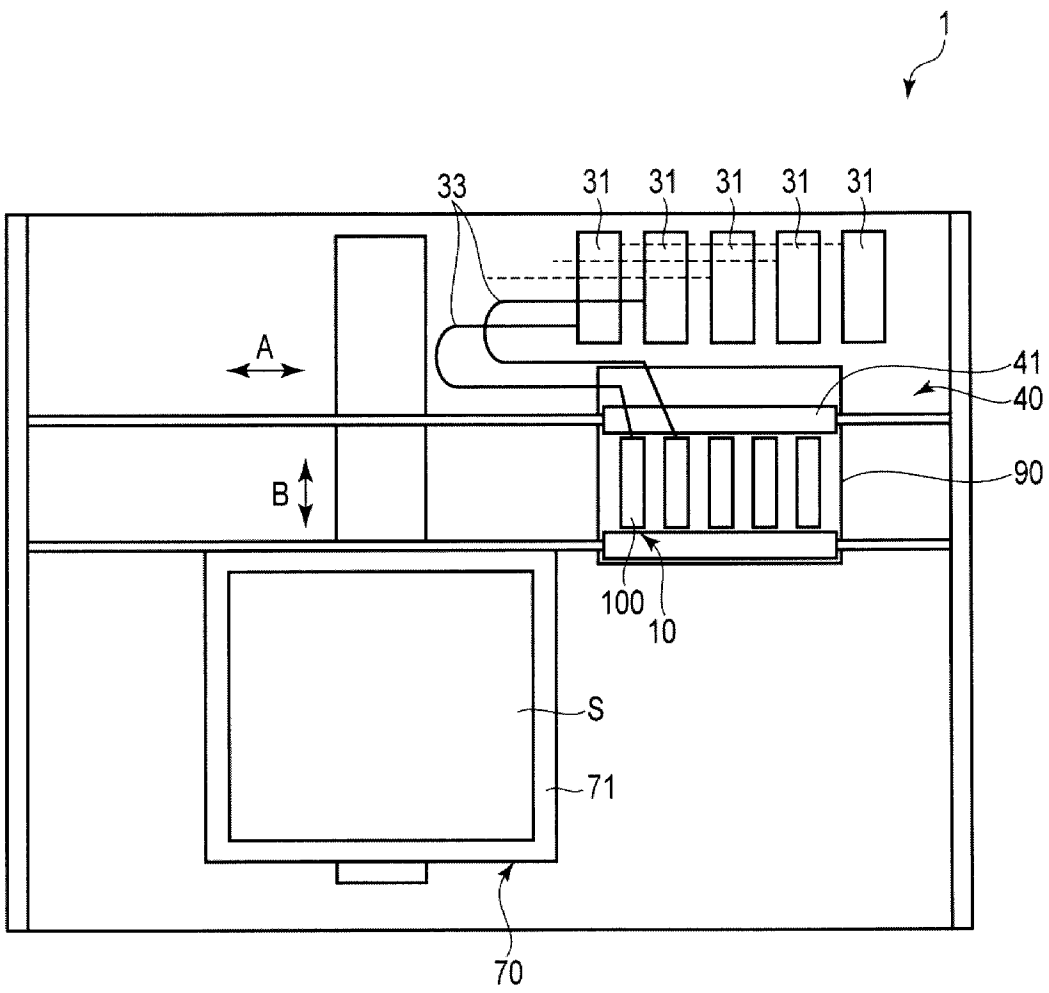
FIG. 2 is a plan view of the ink jet recording apparatus of FIG. 1.

First, the ink jet recording apparatus 1 will be described with reference to FIG. 1 and FIG. 2. FIG. 1 is a front view of the ink jet recording apparatus 1. FIG. 2 is a plan view of the ink jet recording apparatus 1.

The ink jet recording apparatus 1 includes a plurality of ink jet head units 10 and ink cartridges 31 corresponding to the plurality of ink jet head units, respectively. In addition, the ink jet recording apparatus 1 includes a head supporting unit 40 which movably supports the plurality of ink jet head units 10, and a recording medium moving unit 70 which movably supports a recording medium S, and a maintenance unit 90.

The ink jet head unit 10 includes ink jet heads 300, which are liquid discharging units, and ink circulation devices 100, which circulate the ink.

The ink cartridges 31 of each color correspond to each of the ink circulation devices 100 of the ink jet head units 10, and respectively communicated thereto through tubes 33. Each ink cartridge 31 is disposed in a plane relatively lower than a plane of the ink circulation device 100 to assist ink delivery via gravity. Accordingly, a water head pressure of ink I inside the ink cartridge 31 is maintained lower than a setting pressure of a supply chamber 110 of the ink circulation device 100, which is described later (refer to FIG. 6). Also, when the ink cartridge 31 is disposed lower than the ink circulation device 100, the ink cartridge 31 supplies new ink I to the supply chamber 110 (described below) only when a supply pump 150*a* (described below (refer to FIG. 6)) is driven.

The head supporting unit 40 includes a carriage 41 supporting the plurality of ink jet head units 10, a transporting belt 42 reciprocating the carriage 41 in a direction of the arrow A, and a carriage motor 43 driving the transporting belt 42.

The recording medium moving unit 70 includes a table 71 which adsorbs and fixes the recording medium S. The table 71 is mounted on a slide rail device 72 illustrated in FIG. 1 and reciprocated in a direction of the arrow B illustrated in FIG. 2. That is, the recording medium moving unit 70 reciprocates the table 71 in a direction substantially orthogonal to the direction of the carriage 41.

The maintenance unit 90 is movable in a scanning range of the plurality of ink jet head units 10 in the direction of the arrow A, and is disposed on the outside of, or further than a movement range of, the table 71. The maintenance unit 90 is a case body which is opened upwardly, and is provided to be movable in a vertical direction (arrow C and arrow D directions in FIG. 1).

As illustrated in FIG. 1, the maintenance unit 90 includes a blade 91 made of rubber and a waste ink receiving unit 92. The blade 91, made of rubber, removes ink, dust, paper powder, and the like, and is attached to a nozzle plate 310 to be described later (refer to FIG. 3) of the ink jet head 300 of the ink jet head unit 10 of each color. The waste ink receiving unit 92 receives waste ink, dust, paper powder, and the like which are removed by the blade 91. The maintenance unit 90 includes a mechanism for moving the blade 91 in the direction of arrow B, and the blade 91 wipes a surface of the nozzle plate 310.

Figure 3:
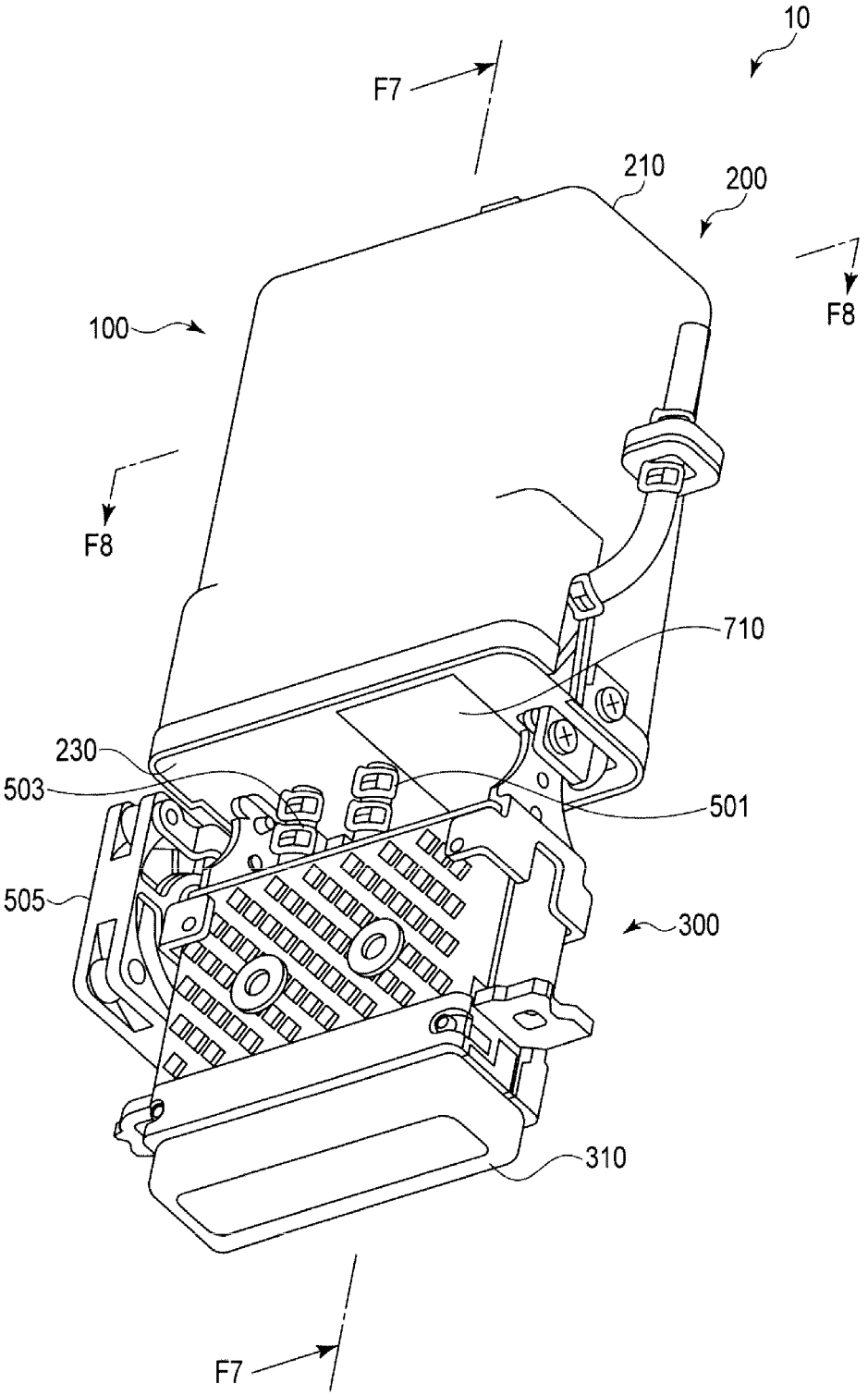
FIG. 3 is a perspective view of an ink jet head unit of the ink jet recording apparatus of FIG. 1.
Figure 4:
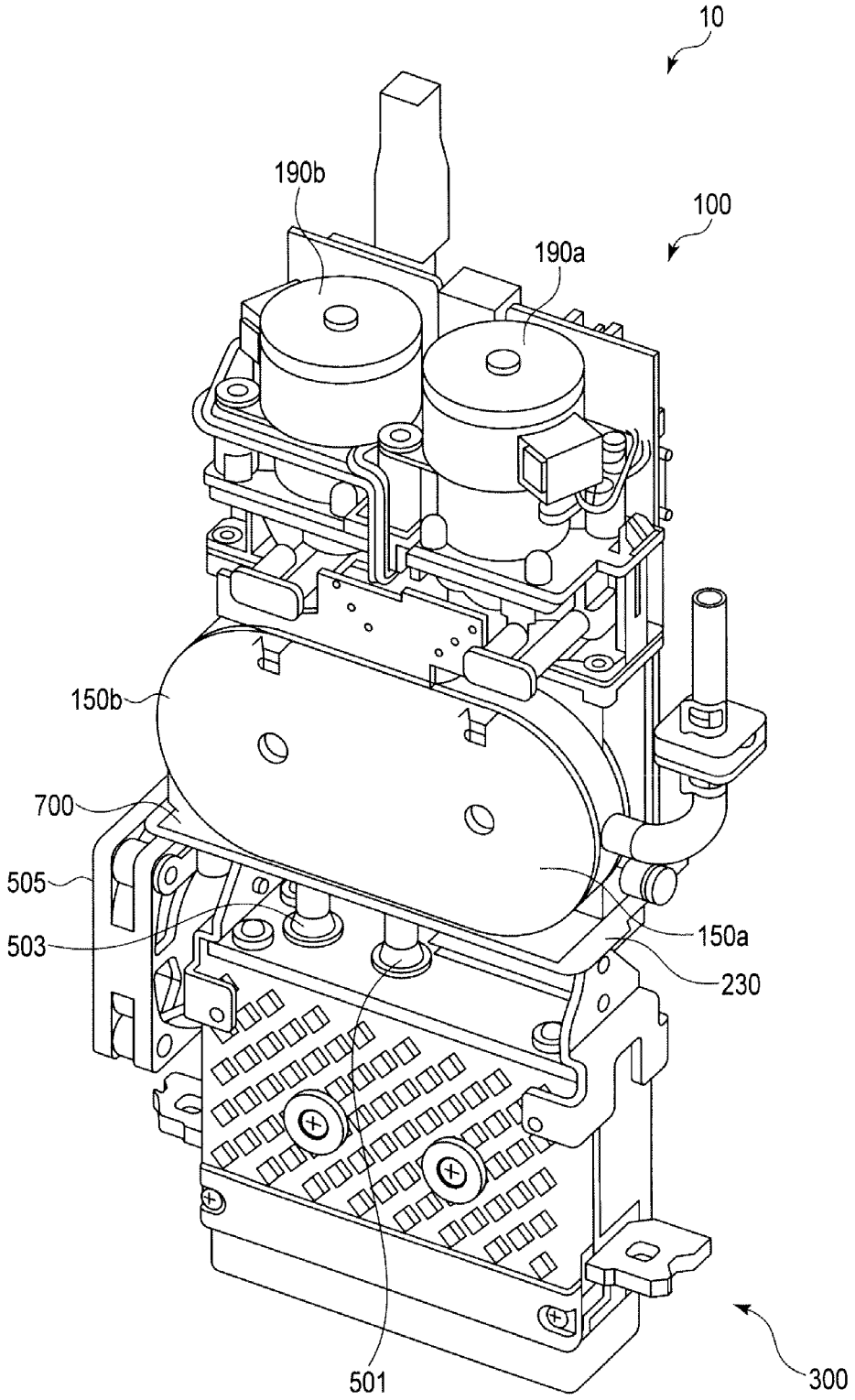
FIG. 4 is a perspective view illustrating a state in which a cover member of the ink jet head unit of FIG. 3 is removed.
Figure 5:
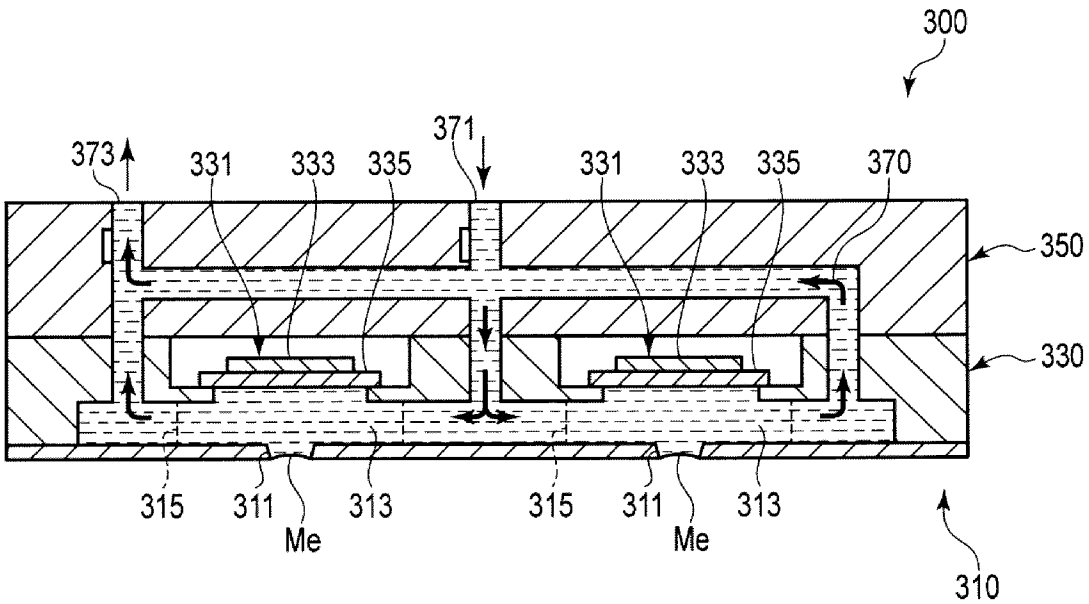
FIG. 5 is a sectional view of a nozzle part of an ink jet head of the ink jet head unit of FIG. 3.
Figure 6:
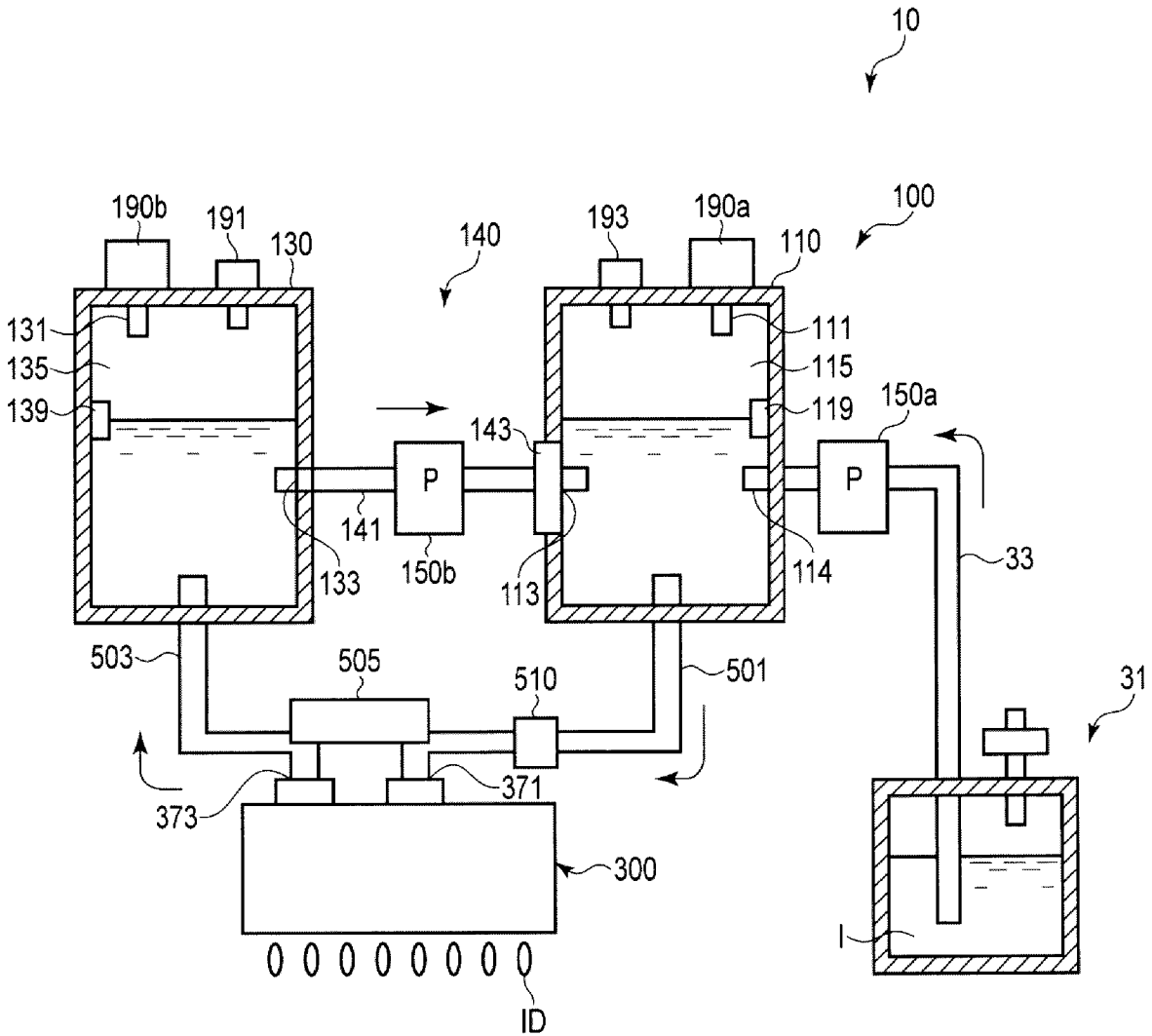
FIG. 6 is a description view illustrating ink flow passages of the ink jet head unit of FIG. 3.
Figure 7:
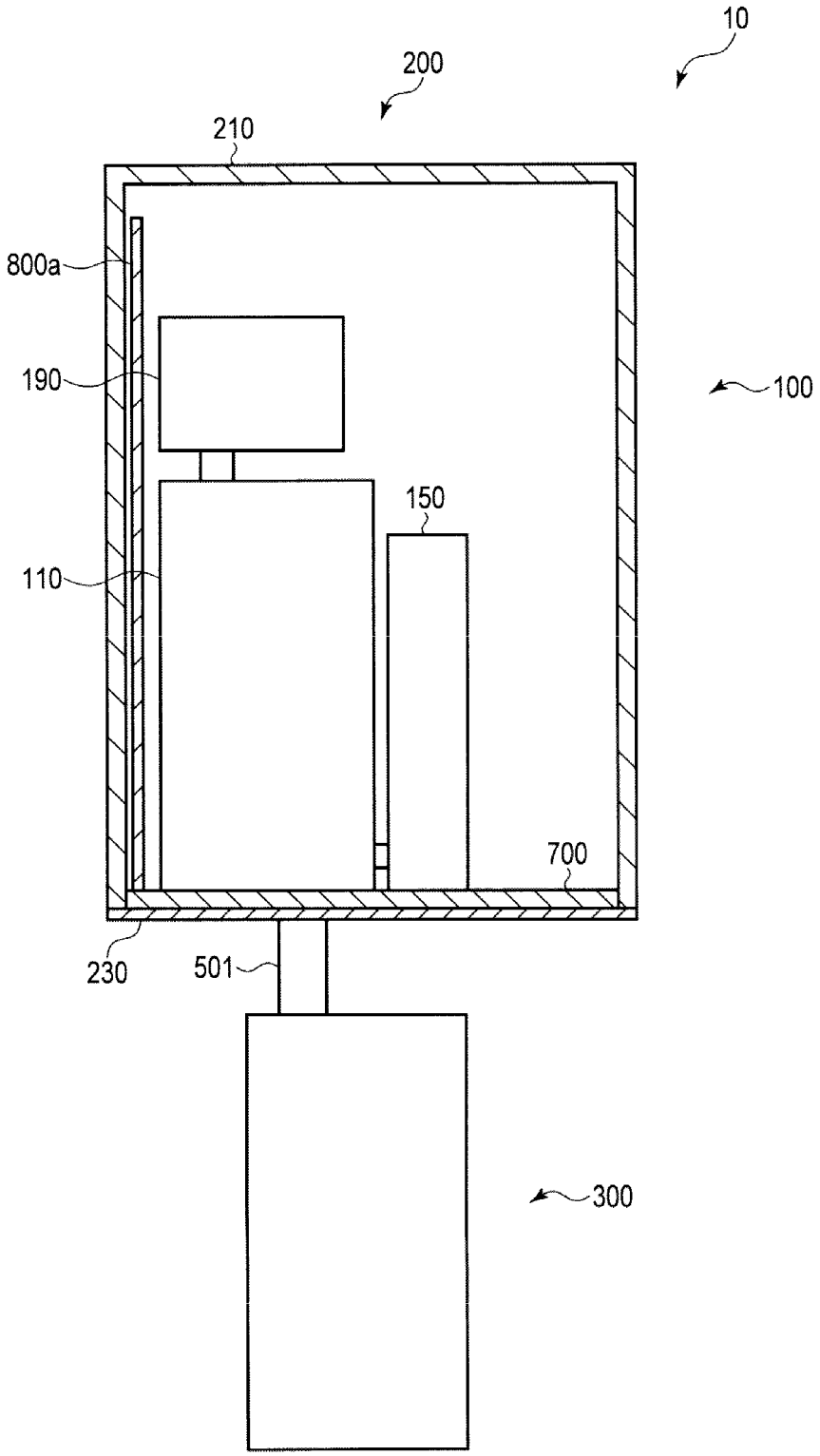
FIG. 7 is a schematic sectional view of the ink jet head unit of FIG. 3 along a line F7-F7.
Figure 8:
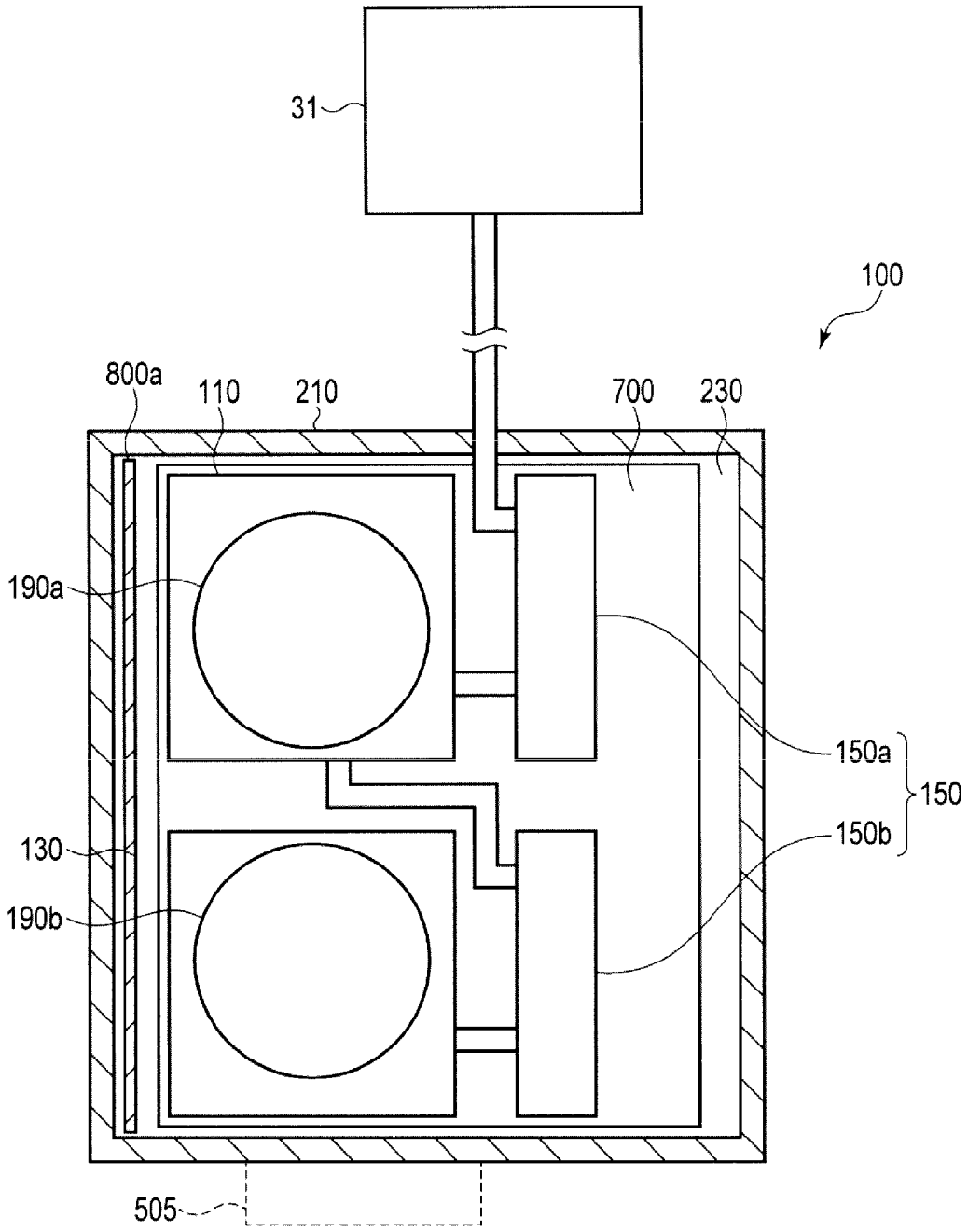
FIG. 8 is a schematic sectional view of the ink jet head unit of FIG. 3 along a line F8-F8.

Subsequently, the inkjet head unit 10 will be described later with reference to FIG. 3 to FIG. 8. FIG. 3 is a perspective view of the ink jet head unit 10. FIG. 4 is a perspective view in a state of removing the cover member 210 of the ink jet head unit 10. FIG. 5 is a sectional view of a nozzle part of the ink jet head 300 of an ink jet head unit 10. FIG. 6 is a description view illustrating the ink flow passage of the ink jet head unit 10. FIG. 7 is a schematic sectional view illustrating arrangement of a main member if the ink jet head unit 10 is sectioned along the F7-F7 line of FIG. 3. FIG. 8 is a schematic sectional view illustrating a state in which the ink jet head unit 10 is sectioned along the F8-F8 line of FIG. 3.

As illustrated in FIG. 3 and FIG. 4, the ink jet head unit 10 includes the ink jet head 300 and the ink circulation device 100 which is integrally provided on the ink jet head 300 in the drawing.

The plurality of ink jet head units 10 respectively discharges, for example, cyan ink, magenta ink, yellow ink, black ink, and white ink to a medium, and a desired image is formed. Also, colors and types of the ink I used for the ink jet head unit 10 are not limited to the embodiment.

For example, the ink jet head unit 10 is capable of discharging transparent gloss ink, and specific ink, which develops color when being irradiated by infrared rays or ultraviolet rays, by being changed into white ink. Moreover, the plurality of ink jet head units 10 respectively uses different ink I but have similar configurations. Accordingly, hereinafter, the same numerals are given to these units.

As illustrated in FIG. 5, the ink jet head 300 includes the nozzle plate 310, including a plurality of nozzles, a substrate 330, positioned to face the nozzle plate 310, and includes a plurality of actuators 331, and a manifold 350 bonded to the substrate 330. Also, the nozzle plate 310 includes, for example, a first nozzle row and a second nozzle row including approximately 150 nozzle holes 311 per one inch.

As illustrated in FIG. 5, the substrate 330 is bonded to face the nozzle plate 310, and includes a plurality of ink pressure chambers 313 between the substrate and the nozzle plate 310. The actuator 331 is provided in a surface facing the nozzle plate 310 of each ink pressure chamber 313. That is, the actuator 331 is positioned to face the nozzle holes 311. The substrate 330 includes a partition wall 315 between the ink pressure chambers 313 adjacent to each other in the same row. The ink pressure chamber 313, which is divided by the partition wall 315, is formed between the actuator 331 and the nozzle hole 311.

As illustrated in FIG. 5, the manifold 350 is a plate shaped member, which is stacked on the substrate 330 in the drawing. The manifold 350 includes a supply port 371 and a discharge port 373 communicating with the ink circulation device 100. In addition, the manifold 350 is assembled with the substrate 330 and the nozzle plate 310, and forms an ink discharging flow passage 370 to be described later.

That is, the ink jet head 300 constitutes a predetermined ink discharging flow passage 370 inside the ink jet head 300 using the nozzle plate 310, the substrate 330, and the manifold 350. As illustrated in FIG. 5, the ink discharging flow passage 370 communicates with a plurality of the ink pressure chambers 313 through the ink discharging flow passage 370 from the supply port 371 formed in the manifold 350. The ink discharging flow passage 370 communicates with the discharge port 373 through the plurality of ink pressure chambers 313.

That is, a part of the ink I passing through the plurality of ink pressure chambers 313 is discharged through the nozzle holes 311. In addition, the ink I which is not discharged is discharged from each of the ink pressure chambers 313 to the discharge port 373 through the ink discharging flow passage 370.

The actuator 331 as illustrated in FIG. 5 is configured to have, for example, a unimorph type piezoelectric vibration plate in which a piezoelectric element 333 and a vibration plate 335 are stacked. The piezoelectric element 333 is constituted by a piezoelectric ceramic material or the like, such as lead zirconate titanate (PZT). The vibration plate 335 is made of, for example, silicon nitride (SiN), or the like.

If the actuator 331 is not deformed, a meniscus Me, which is an interface of the ink I and the air, is formed in the nozzle holes 311 by a surface tension of the ink I. The ink I in the ink pressure chamber 313 is stored inside the nozzle holes 311 due to the meniscus Me.

In the ink jet head 300, if a pressure applied to the meniscus Me of the nozzle holes 311 is higher than an atmospheric pressure (positive pressure), the ink I leaks from the nozzle holes 311. Meanwhile, if a pressure applied to the meniscus Me is lower than the atmospheric pressure (negative pressure), the ink I is stored inside the nozzle holes 311 in a state of maintaining the meniscus Me.

If a predetermined pressure is applied to the piezoelectric element 333, the piezoelectric element 333 is deformed, and the vibration plate 335 is deformed to be protruded toward the ink pressure chamber 313 side. If the vibration plate 335 is deformed to be protruded toward the ink pressure chamber 313 side, a volume of the ink pressure chamber 313 decreases, and a pressure applied to the meniscus Me becomes higher than the atmospheric pressure (positive pressure). For this reason, the ink I is discharged from the nozzle holes 311 in a state in which the meniscus Me thereof is broken and becomes ink droplets (leaking). Moreover, the negative pressure is a pressure less than the atmospheric pressure, and the positive pressure is a pressure greater than the atmospheric pressure.

As illustrated in FIG. 6, the ink circulation device 100 includes the supply chamber 110 (first tank), a recovery chamber 130 (second tank), and a supply pump 150*a*. In addition, the ink circulation device 100 includes a circulation unit 140, a first pressure adjusting mechanism 190*a*, and a second pressure adjusting mechanism 190*b*.

The supply chamber 110 includes the first pressure adjusting mechanism 190*a* thereon in FIG. 6. The supply chamber 110 includes a first communication hole 111 communicating with the first pressure adjusting mechanism 190*a*. The supply chamber 110 communicates with the supply port 371 of the ink jet head 300 through an ink supplying tube 501. In addition, the supply chamber 110 is connected to the ink cartridge 31 through the tubes 33. In addition, the supply chamber 110 includes a liquid hole 113 which is connected to the recovery chamber 130 through a circulation passage 141 to be described below.

The recovery chamber 130 includes the second pressure adjusting mechanism 190*b* thereon. The recovery chamber 130 includes a second communication hole 131 communicating with the second pressure adjusting mechanism 190*b*. The recovery chamber 130 communicates with the discharge port 373 of the ink jet head 300 through an ink returning tube 503. The recovery chamber 130 includes the liquid hole 133 connected to the supply chamber 110 through the circulation passage 141.

Subsequently, two pumps used in the embodiment (supply pump 150*a* and circulation pump 150*b* to be described later)

will be described. Moreover, since two pumps used in the embodiment have the same structure, both of pumps will be described collectively as a pump 150.

Figure 9:
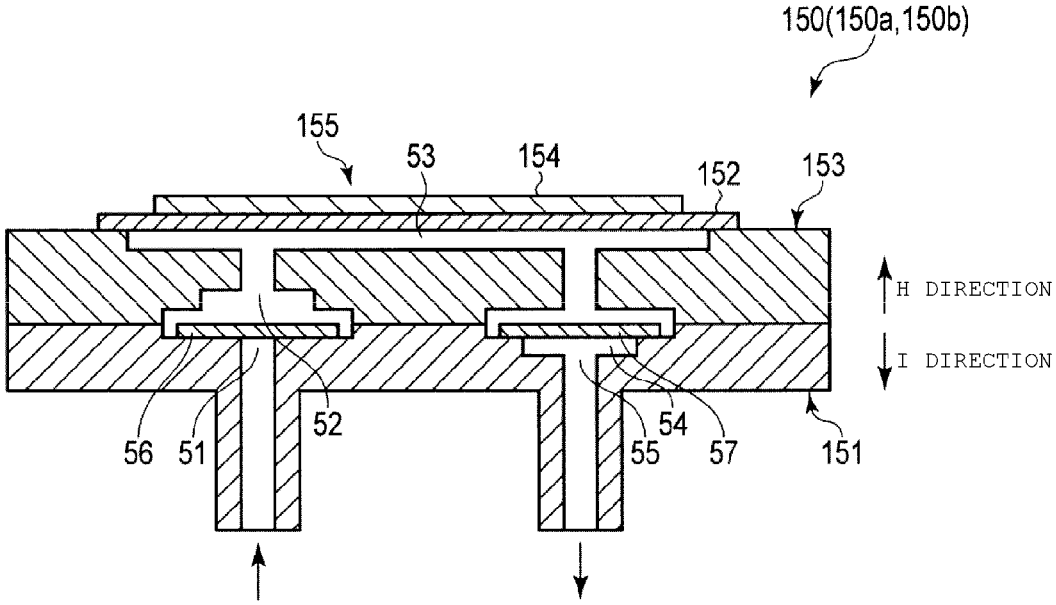
FIG. 9 is a sectional view illustrating a pump mechanism used for an ink circulation device.

As illustrated in FIG. 9, the pump 150 includes a first case 151, a second case 153, and a piezoelectric actuator 155. The pump 150 has an ink flow passage, which reaches a liquid transferring port 55 from an inlet port 51 through a suction chamber 52, a pump chamber 53, and a liquid transferring chamber 54. A first check valve 56, which restricts flow of the ink I in one direction, is provided between the inlet port 51 and the suction chamber 52. A second check valve 57, which restricts flow of the ink I in one direction, is provided between the liquid transferring chamber 54 and the liquid transferring port 55.

The piezoelectric actuator 155 includes a metal plate 152, a piezoelectric ceramic 154 which is fixed on the metal plate 152, and an electrode (not illustrated) constituted by silver paste, or the like. The electrode and the metal plate 152 on the piezoelectric actuator 155 are connected to a driving circuit 870 (to be described later in FIG. 10) through a wire.

The pump 150 periodically expands or contracts a volume of the pump chamber 53 when a piezoelectric vibration plate (the piezoelectric ceramic 154 and the metal plate 152 are bonded with each other) is bent due to a voltage. The pump 150 sequentially pumps the ink I to the suction chamber 52, the pump chamber 53, the liquid transferring chamber 54, and the liquid transferring port 55 from the inlet port 51.

For example, the supply pump 150*a* restricts a flow direction of the ink I in one direction from the ink cartridge 31 (FIG. 2) to the supply chamber 110 (FIG. 6), and pumps the ink I stored in the ink cartridge 31 to the supply chamber 110.

As illustrated in FIG. 6, the circulation unit 140 includes the circulation pump 150*b* and a filter 143 in intermediate positions on the circulation passage 141, which connects the supply chamber 110 and the recovery chamber 130.

The circulation pump 150*b* restricts a flow direction of the ink I in one direction from the recovery chamber 130 to the supply chamber 110, and pumps the ink I stored in the recovery chamber 130 to the supply chamber 110.

That is, the circulation pump 150*b* has a function of transferring the ink I, which is not discharged from the nozzle holes 311 (refer to FIG. 5) but remains in the ink jet head 300, to the recovery chamber 130, and returning the ink I stored in the recovery chamber 130 to the supply chamber 110.

As illustrated in FIG. 6, the filter 143 is provided, for example, further downstream in a circulation direction than the circulation pump 150*b* of the circulation passage 141 so as to remove a foreign material mixed into the ink I. As the filter 143, for example, a mesh filter, such as polypropylene, nylon, polyphenylene sulfide, or stainless steel can be used. Moreover, the filter 143 can be disposed near an inlet of the ink supplying tube 501 of the supply chamber 110.

In addition, bubbles in the ink I, which are generated while circulating the ink I from the recovery chamber 130 to the supply chamber 110 by the circulation unit 140, float in an upward direction in FIG. 6 by buoyancy. The bubbles floated by buoyancy are moved to an air chamber 135 side, higher than a liquid surface of the recovery chamber 130, or to an air chamber 115 side, higher than a liquid surface of the supply chamber 110, and are removed from the ink I.

As illustrated in FIG. 4 and FIG. 6, the first pressure adjusting mechanism 190*a* is provided on the supply chamber 110 in the drawings. The first pressure adjusting mechanism 190*a* adjusts a pressure inside the supply chamber 110.

As illustrated in FIG. 4 and FIG. 6, the second pressure adjusting mechanism 190*b* is provided on the recovery chamber 130 in the drawings. The second pressure adjusting mechanism 190*b* adjusts a pressure inside the recovery chamber 130.

That is, the first pressure adjusting mechanism. 190*a* and the second pressure adjusting mechanism 190*b* adjust pressure of the supply chamber 110 and the recovery chamber 130 (perform adjusting by fixing the pressure of the supply chamber 110 and changing the pressure of the recovery chamber 130, regarding the ink circulation device 100 of the embodiment) so as to adjust the meniscus Me of the nozzle holes 311 (refer to FIG. 5).

Next, various sensors provided in each unit of the ink circulation device 100 will be described.

As illustrated in FIG. 6, the ink circulation device 100 is provided with a first ink-amount sensor 119 measuring an ink amount of the supply chamber 110 and a second ink-amount sensor 139 measuring an ink amount of the recovery chamber 130.

The first ink-amount sensor 119 and the second ink-amount sensor 139 are sensors, for example, which measure an ink amount by detecting vibration of the ink I flowing in the recovery chamber 130 or the supply chamber 110 when the piezoelectric vibration plate is vibrated with an AC voltage. Moreover, the first ink-amount sensor 119 and the second ink-amount sensor 139 are not limited to the sensor described above. For example, the first ink-amount sensor 119 and the second ink-amount sensor 139 may be a sensor measuring a height of a surface of the liquid.

In addition, as illustrated in FIG. 6, the ink circulation device 100 includes a first pressure sensor 191, which detects pressure inside the recovery chamber 130, and a second pressure sensor 193, which detects pressure inside the supply chamber 110, as a pressure detecting unit.

The first pressure sensor 191 and the second pressure sensor 193 are, for example, semiconductor piezoelectric resistance pressure sensors. The semiconductor piezoelectric resistance pressure sensor includes a diaphragm, which receives pressure from the outside, and a semiconductor strain gauge formed on a surface of the diaphragm. Also, the sensor detects pressure by converting a change of electric resistance according to a piezoelectric resistance effect, which is generated in a strain gauge due to a deformation of the diaphragm by a pressure from the outside, to an electric signal.

In addition, the ink supplying tube 501 includes a temperature sensor 510 detecting the temperature of the ink I in an intermediate position thereon.

Next, a cover body 200 and a heater 700 (heating device) provided in the ink circulation device 100 of the embodiment will be described with reference to FIG. 3, FIG. 7, and FIG. 8. The heating device may be a single or unitary heater as shown in the FIGS.

As illustrated in FIG. 3, the cover body 200 includes the cover member 210 and a base member 230. As illustrated in FIG. 7, the base member 230 is provided between the ink jet head 300 and the heater 700, and is a plate shape member disposed to face the ink jet head 300. As illustrated in FIG. 8, the heater 700, which is a so-called panel heater, is stacked on a surface of the base member 230 which is on the opposite side of the ink jet head 300. As illustrated in FIG. 7, the supply chamber 110, the recovery chamber 130, the supply pump 150*a*, and the circulation pump 150*b* (collectively referenced as 150 in FIG. 7) are mounted on the heater 700 in the drawing.

As illustrated in FIG. 7, the heater 700 is mounted so as to be in contact with a bottom surface of the supply chamber 110, a bottom surface of the recovery chamber 130, a bottom surface of the supply pump 150*a*, and a bottom surface of the circulation pump 150*b* (collectively referenced as 150 in FIG. 7). The heater 700 is provided, for example, almost entire surface of the base member 230.

As illustrated in FIG. 3, the cover member 210 is a dome shape member that covers the first pressure adjusting mechanism 190*a*, the second pressure adjusting mechanism 190*b*, the supply chamber 110, the recovery chamber 130, the supply pump 150*a*, and the circulation pump 150*b*. The cover member 210 partitions an outside space and an inside space of the cover member 210 by closing an opening of the cover member 210 with the base member 230.

That is, the cover member 210 allows air, which is heated by the heater 700 disposed the base member 230, to be stored in a space or volume inside the cover member 210. Also, because of the heated air inside the cover member 210, the first pressure adjusting mechanism 190*a*, the second pressure adjusting mechanism 190*b*, the supply chamber 110, the recovery chamber 130, the supply pump 150*a*, and the circulation pump 150*b* are heated using the air.

The cover body 200 is formed of a material having a heat insulation effect. Moreover, although not illustrated in the drawings, heat insulation members are further disposed to be overlapped with each other in or on an inner wall of the cover body 200, and thus a heat insulation capacity can be improved.

In addition, as illustrated in FIG. 3 and FIG. 4, the ink jet head unit 10 includes the ink jet head 300, the ink supplying tube 501, and the cooling unit 505 which cools the ink returning tube 503. The cooling unit 505 is, for example, an air cooling fan. Moreover, the heater 700 and the cooling unit 505 are driven by the driving circuit 870 (refer to FIG. 10) to be described later.

Figure 10:
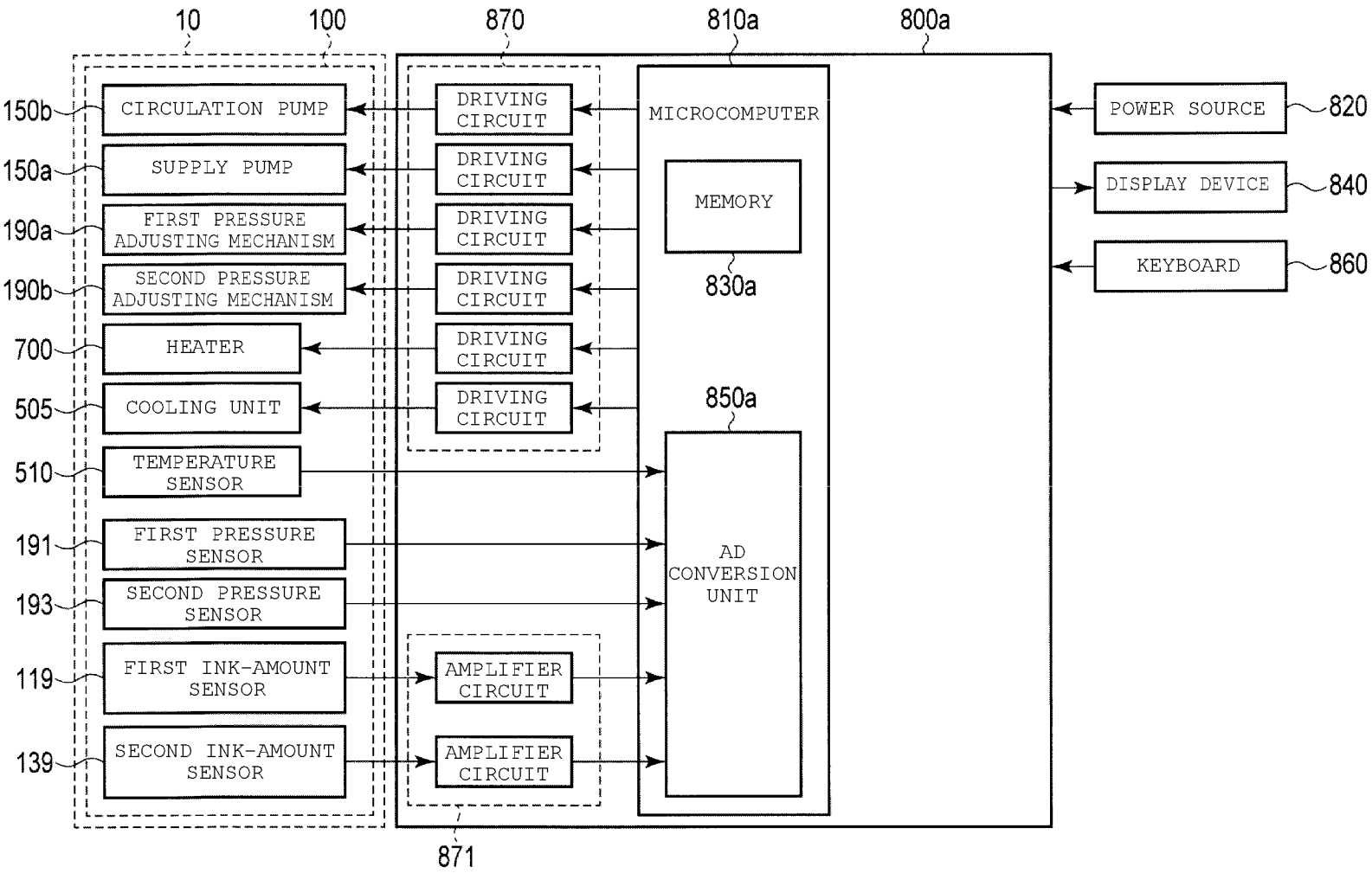
FIG. 10 is a block diagram illustrating a control of the ink circulation device of FIG. 3.

Next, as illustrated in FIG. 10, a control system of the ink circulation device 100 will be describe using a block diagram of the ink circulation device 100. A control substrate 800*a* includes a microcomputer 810*a* which controls the ink circulation device 100, a driving circuit 870 driving the ink circulation device 100, and an amplifier circuit 871.

The microcomputer 810*a* includes a memory 830*a* which stores programs, various data, or the like, and an AD conversion unit 850*a* which reads an output voltage from the ink circulation device 100.

The microcomputer 810*a* reads information detected by the first pressure sensor 191, the second pressure sensor 193, the first ink-amount sensor 119, the second ink-amount sensor 139, and the temperature sensor 510, using the AD conversion unit 850*a*.

The microcomputer 810*a* controls an operation of the circulation pump 150*b*. The microcomputer 810*a* controls an operation of the circulation pump 150*b*, for example, by controlling a flow speed of the ink I which is circulated between the supply chamber 110, the recovery chamber 130, and the ink jet head 300.

In addition, based on pressure information detected by the first pressure sensor 191 and the second pressure sensor 193, the microcomputer 810*a* controls operations of the first pressure adjusting mechanism 190*a*, the second pressure adjusting mechanism 190*b* and the supply pump 150*a*, and adjusts pressure of the recovery chamber 130 and the supply chamber 110.

In addition, the microcomputer 810*a* has a function of controlling electric energization of the heater 700 so that the temperature of ink is in a range of an optimum temperature zone if the temperature of the ink I is lower than a lower limit value of the optimum temperature zone. In addition, if the temperature of the ink I is higher than an upper limit value of the optimum temperature zone, the microcomputer 810*a* controls the electric energization of the cooling unit 505 so that the temperature of ink is in a constant range. Also, control of the heater 700 and the cooling unit 505 will be described later in detail with reference to a flow chart illustrated in FIG. 12.

The substrate 800*a* is connected to a power source 820, a display device 840 which displays a state of the ink circulation device 100, and a keyboard 860 which is an input device. The control substrate 800*a* is connected to a driving unit or various sensors of the supply pump 150*a* and the circulation pump 150*b* of the ink jet head unit 10.

Next, a control system of the ink jet recording apparatus will be described with reference to a block diagram of the ink jet recording apparatus 1 illustrated in FIG. 11. The control substrate 800*b* includes the microcomputer 810*b* controlling an ink jet head 300, a head driving circuit 873 driving the ink jet head 300, and a driving circuit 875 driving the carriage motor 43, the maintenance unit 90, and the recording medium moving unit 70.

In addition, the control substrate 800*b* is connected to the power source 820, the display device 840 which displays a state of the inkjet recording apparatus 1, and the keyboard 860 which is an input device.

Subsequently, an operation before printing of the ink jet recording apparatus 1 will be described.

The microcomputer 810*a* illustrated in FIG. 10 starts filling the respectively corresponding ink jet head units 10 with the ink I from the ink cartridge 31 of each color.

Figure 11:
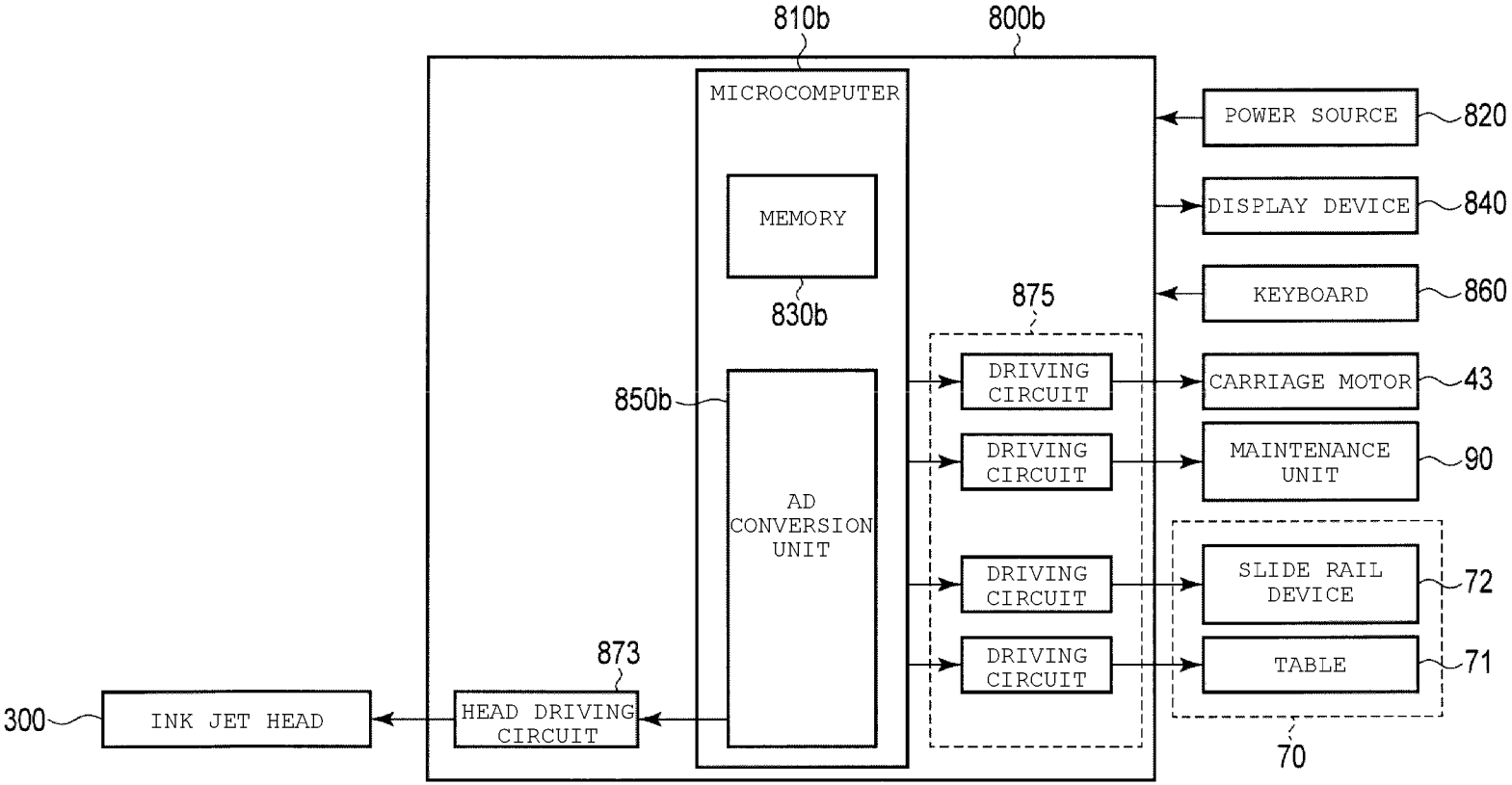
FIG. 11 is a block diagram illustrating a control of the ink jet recording apparatus of FIG. 1.

The microcomputer 810*b* illustrated in FIG. 11 returns the ink jet head unit 10 of each color to a waiting position, and raises the maintenance unit 90 in a direction of an arrow D (refer to FIG. 1) so as to cover the nozzle plate 310.

The microcomputer 810*a* drives the supply pump 150*a*, and pumps the ink I to the supply chamber 110 from the ink cartridge 31. If a liquid surface of the ink I inside the supply chamber 110 reaches the liquid hole 114, the microcomputer 810*a* drives the circulation pump 150*b* while adjusting pressure inside the supply chamber 110 and the recovery chamber 130 using the first pressure adjusting mechanism 190*a* and the second pressure adjusting mechanism 190*b*.

Figure 12:
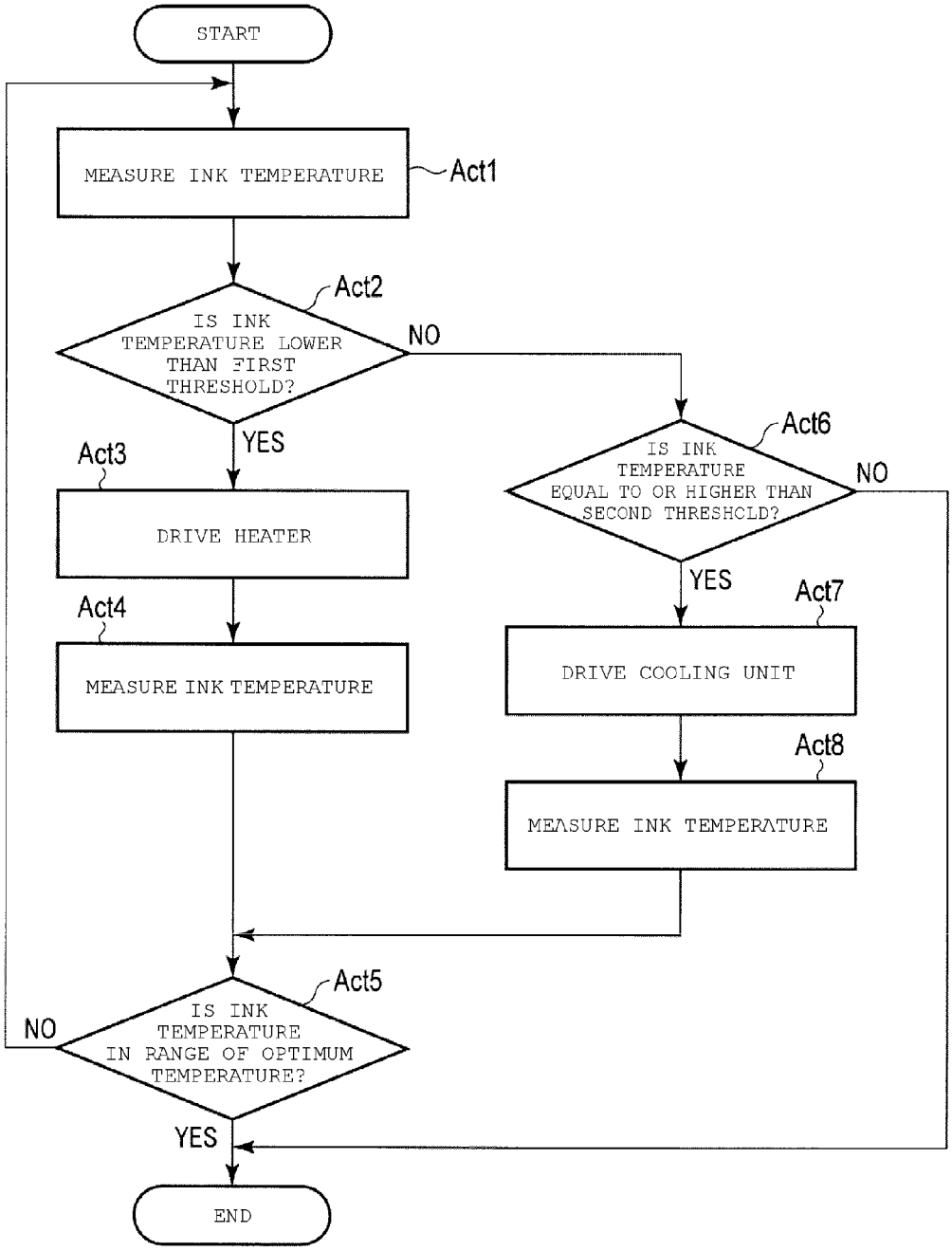
FIG. 12 is a control flow view of a temperature of ink inside the ink jet head of FIG. 3.

Next, a control operation of the ink temperature of the ink transferred to the ink jet head unit 10 will be described with reference to a flow chart of FIG. 12. Moreover, in the flow chart, a lower limit value of the optimum temperature zone is indicated as a first threshold, and an upper limit value of the optimum temperature zone is indicated as a second threshold to aid in the description. The optimum temperature zone described here is a range of temperatures suitable for respectively discharging unique ink droplets of each ink.

The microcomputer 810*a* drives the circulation pump 150*b*. The microcomputer 810*a* measures the temperature of ink with the temperature sensor 510 disposed in the intermediate position on the ink supplying tube 501 (Act 1).

If the temperature of ink measured with the temperature sensor 510 is lower than the first threshold (Yes in Act 2), the microcomputer 810*a* drives the heater 700 (Act 3).

Also, the microcomputer 810*a* measures the temperature of ink again with the temperature sensor 510 after a certain period of time elapses (Act 4). If the temperature of ink measured with the temperature sensor 510 is in the optimum temperature zone (Yes in Act 5), the microcomputer 810*a* stops the heater 700 and terminates a control operation of the temperature of ink.

Moreover, if the temperature of ink measured with the temperature sensor 510 is not in the optimum temperature zone in Act 4 (No in Act 5), the microcomputer 810*a* returns to Act 1.

Next, a case in which the temperature of ink measured with the temperature sensor 510 is not lower than the first threshold in Act 2 (No in Act 2) will be described. In this case, the microcomputer 810*a* determines whether or not the temperature of ink is equal to or higher than the second threshold (Act 6). If the temperature of ink measured through the temperature sensor 510 is not equal to or higher than the second threshold (No in Act 6), the microcomputer 810*a* terminates the control operation of the temperature of ink because the temperature of ink is in a range of the optimum temperature zone.

Meanwhile, if the temperature of ink is equal to or higher than the second threshold (Yes in Act 6), the microcomputer 810*a* drives the cooling unit 505 (refer to FIG. 6) (Act 7). The microcomputer 810*a* measures the temperature of ink again with the temperature sensor 510 after a certain period of time elapses (Act 8). If the measured temperature of ink is in the range of the optimum temperature zone (Yes in Act 5), the microcomputer 810*a* stops the cooling unit 505 and terminates the control operation of the temperature of ink.

Moreover, if the temperature of ink measured with the temperature sensor 510 in Act 8 is not in the range of the optimum temperature zone (No in Act 5), the microcomputer 810*a* returns to Act 1 and repeats operations described above.

That is, the microcomputer 810*a* regularly measures the temperature of ink while circulating the ink I and driving the circulation pump 150*b*, and performs a so-called ON-OFF control of the heater 700 or the cooling unit 505. Accordingly, the microcomputer 810*a* controls the temperature of ink circulated inside the ink circulation device 100 within the range of the optimum temperature zone.

Moreover, if there is a concern that a deviation is generated in the temperature of ink being discharged and the temperature detected by the temperature sensor 510, the microcomputer 810*a* records a difference in the temperatures of ink in the memory 830*a* in advance, and is capable of controlling the temperature of ink so as to appropriately correct the temperature.

In addition, the installation position of the temperature sensor 510 is not limited to the intermediate position on the ink supplying tube 501 shown in FIG. 6. For example, the sensor can be provided inside the recovery chamber 130 or the supply chamber 110, or in an intermediate position on a flow passage of the ink discharging flow passage 370 of the ink jet head 300 (refer to FIG. 5).

Hereinafter, subsequently, a printing operation of the ink jet recording apparatus 1 will be described.

According to the operation described above, the ink jet head unit 10 of the ink jet recording apparatus 1 is filled with each color of ink, and the temperature of all ink is in the optimum temperature zone, which is suitable for being discharged, and then the microcomputer 810*b* illustrated in FIG. 11 starts a printing operation.

The microcomputer 810*b* controls the recording medium moving unit 70, adsorbs and fixes the recording medium S to the table 71, and reciprocates the table 71 in the direction of arrow B. The microcomputer 810*b* moves the maintenance unit 90 in the direction of arrow C (refer to FIG. 1). In addition, the microcomputer 810*b* transports the carriage 41 in a direction of the recording medium S by controlling the carriage motor 43, and reciprocates the carriage in the direction of arrow A (refer to FIG. 2).

Moreover, while reciprocating the ink jet head unit 10 along the transporting belt 42 in the direction of arrow A (refer to FIG. 2), a distance h between the nozzle plate 310 of the inkjet head 300 and the recording medium S is constantly maintained.

The microcomputer 810*b* reciprocates the inkjet head 300 in a direction orthogonal to a transportation direction of the recording medium S and forms an image on the recording medium S. The microcomputer 810*b* controls the ink jet head 300 in response to an image forming signal, and forms an image on the recording medium S by discharging the ink I from the nozzle holes 311 provided on the nozzle plate 310.

The microcomputer 810*b*, for example, selectively drives the actuator 331 of the inkjet head 300 in response to an image signal in accordance with image data stored in the memory 830*b*, and discharges ink droplets ID (refer to FIG. 6) onto the recording medium S from the nozzle holes 311.

The microcomputer 810*a* drives the circulation pump 150*b*, and pumps the discharged ink I which is not discharged to the recovery chamber 130, the circulation pump 150*b*, and the supply chamber 110 from the ink jet head 300, and supplies the ink to the ink jet head 300 again.

At the time of printing, the microcomputer 810*a* controls the first pressure adjusting mechanism 190*a*, the second pressure adjusting mechanism 190*b*, the supply pump 150*a*, and the circulation pump 150*b*, and adjusts pressure and an ink flowing amount of the supply chamber 110 and the recovery chamber 130.

For example, if ink droplets ID are discharged from the nozzle holes 311 at the time of printing, an ink amount of the supply chamber 110 and the recovery chamber 130 is instantly reduced, and pressure of the recovery chamber 130 is decreased. The microcomputer 810*a* detects pressure and the ink amount of the supply chamber 110 and the recovery chamber 130 using the first pressure sensor 191, the second pressure sensor 193, the first ink-amount sensor 119, and the second ink-amount sensor 139. Based on detected information, the microcomputer 810*a* drives the first pressure adjusting mechanism 190*a*, the second pressure adjusting mechanism 190*b*, or the supply pump 150*a*, and adjusts pressure and the ink amount inside the recovery chamber 130 and the supply chamber 110.

In addition, the microcomputer 810*a* removes bubbles or a foreign material mixed in the ink I by circulating the ink I. In addition, the microcomputer 810*a* maintains the temperature of ink by circulating the ink I to be uniform. Accordingly, the ink jet recording apparatus 1 can properly maintain an ink discharging performance using the inkjet head unit 10.

As described above, the ink circulation device 100 of the embodiment heats the supply chamber 110, the recovery chamber 130, or the like from the outside. For this reason, the heater 700 and the ink I are not directly in contact with each other. Accordingly, the temperature of ink transferred to the inkjet head unit 10 can be prevented from being locally increased. That is, the ink circulation device 100 of the embodiment can almost uniformly heat the entirety of the ink and maintain the temperature thereof.

In addition, the ink circulation device 100 heats not only parts that store the ink I (such as the supply chamber 110, and the recovery chamber 130), but also the circulation pump 150*b* and the supply pump 150*a* collectively. In other words, the ink circulation device 100 can indirectly heat the ink at a plurality of positions along the ink flow passage by the heater 700.

As a result, since the ink flowing inside the ink circulation device 100 is gradually heated at the plurality of positions, the temperature of ink is prevented from being locally increased and is capable of uniformly increasing the temperature of ink up to the optimum temperature zone in which the ink is effectively discharged.

In addition, as illustrated in FIG. 3, the ink circulation device 100 of the embodiment includes the cover body 200. The ink circulation device 100 includes the cover member 210, thereby heat from the heater 700 provided in the base member 230 can be prevented from exiting the heater.

That is, the ink circulation device 100 includes the cover member 210, thereby the temperature of ink can rise faster than when the cover member 210 is not provided. In addition, the ink circulation device 100 includes the cover member 210, thereby reduces heat loss by radiation and consumption of electric power, which may be used for increasing the temperature of ink.

In addition, in the embodiment, the heater 700 is disposed to be in contact with a bottom surface of the supply chamber 110, a bottom surface of the recovery chamber 130, a bottom surface of the circulation pump 150*b*, and a bottom surface of the supply pump 150*a*. Accordingly, the ink I, which is accumulated in the bottom of the supply chamber 110, the recovery chamber 130, the supply pump 150*a*, and the circulation pump 150*b*, can be effectively heated from the bottom surface side.

In addition, as illustrated in FIG. 3, a heat accumulation section 710 (heat sink) may be provided in the base member 230. Accordingly, a temperature decrease due to heat radiation can be prevented.

In addition, the pump 150 (circulation pump 150*b* and supply pump 150*a*) is formed to be small and thin, and can transfer the ink I. However, if the heater 700 is capable of effective heating, it is not limited to the types of pumps 150 (circulation pump 150*b* and supply pump 150*a*) shown. For example, as the pump 150 (circulation pump 150*b* and supply pump 150*a*), a tube pump, a diaphragm pump, a piston pump, or the like can be used.

In addition, the ink circulation device 100 can be used as a liquid discharging apparatus which discharges liquid other than ink. For example, the ink circulation device 100 can be used as an apparatus discharging liquid which includes conductive particles for forming a wiring pattern of a print wiring substrate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink circulation device comprising:
a first tank that stores ink to be supplied to an ink jet head;
a second tank that stores the ink returned from the ink jet head;
a circulation pump that circulates the ink stored in the second tank to the first tank; and
a heating device that is in contact with and heats a bottom surface of the first tank, a bottom surface of the second tank, and a bottom surface of the circulation pump.

2. The device according to claim 1,
wherein the heating device is a single heater in contact with the bottom surface of the first tank, the bottom surface of the second tank, and the bottom surface of the circulation pump.

3. The device according to claim 2, further comprising:
a supply pump that pumps the ink to the first tank,
wherein the heater is in contact with a bottom surface of the supply pump and heats the supply pump as well as the first tank, the second tank, and the circulation pump.

4. The device according to claim 3, further comprising:
a cover body that covers the first tank, the second tank, the circulation pump, and the supply pump.

5. The device according to claim 1, further comprising:
a supply pump that pumps the ink to the first tank,
wherein the heating device is in contact with a bottom surface of the supply pump and heats the supply pump as well as the first tank, the second tank, and the circulation pump.

6. The device according to claim 5, further comprising:
a cover body that covers the first tank, the second tank, the circulation pump, and the supply pump.

7. The device according to claim 6, further comprising:
a first pressure adjusting mechanism and a second pressure adjusting mechanism that is covered by the cover body.

8. The device according to claim 7, wherein
air within the cover body is heated by the heating device.

9. The device according to claim 1, further comprising:
a cover body that covers the first tank, and the second tank, the circulation pump.

10. An ink jet recording apparatus comprising:
an ink jet head that discharges ink;
a first tank that stores the ink to be supplied to the ink jet head;
a second tank that stores the ink returned from the ink jet head;
a circulation pump that circulates the ink stored in the second tank to the first tank; and
a single heater that is in contact with a bottom surface of the first tank, a bottom surface of the second tank, and a bottom surface of the circulation pump, and heats the ink circulated inside the first tank, the second tank, and the circulation pump.

11. The device according to claim 10, further comprising:
a supply pump that pumps the ink to the first tank,
wherein the heater is in contact with a bottom surface of the supply pump and heats the supply pump as well as the first tank, the second tank, and the circulation pump.

12. The device according to claim 11, further comprising:
a cover body that covers the first tank, the second tank, the circulation pump, and the supply pump.

13. The device according to claim 10, further comprising:
a supply pump and a cover body that covers the first tank, the second tank, the circulation pump, and the supply pump.

14. The device according to claim 13, further comprising:
a first pressure adjusting mechanism and a second pressure adjusting mechanism that is covered by the cover body.

15. The device according to claim 14, wherein
air within the cover body is heated by the heater.

16. The device according to claim 10, further comprising:
a cooling unit positioned adjacent to the circulation pump.

17. An ink jet recording apparatus comprising:
an ink jet head that discharges ink;
a first tank that stores the ink to be supplied to the ink jet head;

a second tank that stores the ink returned from the ink jet head;

a circulation pump that circulates the ink stored in the second tank to the first tank;

a supply pump that pumps ink from the first tank to the inkjet head; and a single heater that is in contact with a bottom surface of the first tank, a bottom surface of the second tank, and a bottom surface of the circulation pump, and heats the ink circulated inside the first tank, the second tank, and the circulation pump.

18. The device according to claim 17, further comprising:

a cover body that covers the first tank, the second tank, the circulation pump, and the supply pump.

19. The device according to claim 18, further comprising:

a first pressure adjusting mechanism and a second pressure adjusting mechanism that is covered by the cover body.

20. The device according to claim 19, wherein air within the cover body is heated by the heater.

* * * * *